US012262761B2

(12) United States Patent
Zhang et al.

(10) Patent No.: US 12,262,761 B2
(45) Date of Patent: Apr. 1, 2025

(54) ADAPTIVE STRAPS FOR BRASSIERE PRODUCTS AND THE METHOD OF MAKING THE SAME

(71) Applicant: Four K Knitters Ltd, Hong Kong (HK)

(72) Inventors: Kang Zhang, Hong Kong (HK); Shilong Zhang, Hong Kong (HK); Jifan Li, Hong Kong (HK); Sui Lung Cheung, Hong Kong (HK)

(73) Assignee: Four K Knitters Ltd, Hong Kong (HK)

( * ) Notice: Subject to any disclaimer, the term of this patent is extended or adjusted under 35 U.S.C. 154(b) by 0 days.

(21) Appl. No.: 18/253,923

(22) PCT Filed: Sep. 16, 2022

(86) PCT No.: PCT/CN2022/119189

§ 371 (c)(1),
(2) Date: May 23, 2023

(87) PCT Pub. No.: WO2023/041000

PCT Pub. Date: Mar. 23, 2023

(65) Prior Publication Data

US 2024/0000164 A1 Jan. 4, 2024

Related U.S. Application Data

(60) Provisional application No. 63/245,206, filed on Sep. 17, 2021.

(51) Int. Cl.
*A41C 3/12* (2006.01)

(52) U.S. Cl.
CPC ..... *A41C 3/12* (2013.01)

(58) Field of Classification Search
CPC ..... A41C 3/12
(Continued)

(56) References Cited

U.S. PATENT DOCUMENTS

2008/0261491 A1* 10/2008 Scheininger ..... D04B 1/18 450/41
2012/0100351 A1 4/2012 Covelli et al.
(Continued)

FOREIGN PATENT DOCUMENTS

CN 106723560 A 5/2017
CN 109222304 A 1/2019
(Continued)

OTHER PUBLICATIONS

International Search Report and Written Opinion of the corresponding PCT application No. PCT/CN2022/119189 mailed on Dec. 13, 2022.
(Continued)

*Primary Examiner* — Gloria M Hale
(74) *Attorney, Agent, or Firm* — Idea Intellectual Limited; Margaret A. Burke; Sam T. Yip

(57) ABSTRACT

Provided is an adaptive strap for brassieres having at least one adaptive material layer (10) having a first strength modulus x during static loading and a second strength modulus of at least 2× during dynamic loading of at least approximately 3 Hz oscillation. The adaptive layer (10) is sandwiched between two or more elastic fabric layers (20). The adaptive strap is extendable up to 100% of its initial length during low wearer activity but is extendable not more than 50% during vigorous wearer activity, providing support during exercise and comfort during daily use. In one aspect the adaptive material is a reaction product formed by reacting a silanol terminated polydimethylsiloxane, polymer
(Continued)

matrix, boric acid and optional fillers. The adaptive material (10) is cured in situ within the elastic fabric layers (20).

16 Claims, 5 Drawing Sheets

(58) Field of Classification Search
USPC ..... 450/86
See application file for complete search history.

(56) References Cited

U.S. PATENT DOCUMENTS

| | | | | |
|---|---|---|---|---|
| 2012/0309249 | A1 | 12/2012 | Von Bokern et al. | |
| 2015/0374042 | A1* | 12/2015 | Abbott | A41B 9/04 2/400 |
| 2018/0279692 | A1 | 10/2018 | Witek et al. | |
| 2020/0345082 | A1 | 11/2020 | Witek et al. | |
| 2021/0112897 | A1* | 4/2021 | Farmer | B32B 7/14 |

FOREIGN PATENT DOCUMENTS

| | | | |
|---|---|---|---|
| CN | 111134409 | A | 5/2020 |
| CN | 113907450 | A | 1/2022 |
| JP | 2014163018 | A | 9/2014 |
| JP | 2015519086 | A | 7/2015 |
| JP | 2018104560 | A | 7/2018 |
| KR | 200334389 | Y1 | 11/2003 |
| WO | 2013091061 | A1 | 6/2013 |

OTHER PUBLICATIONS

Office Action of the corresponding Japan patent application No. 2023-523614 mailed on Mar. 27, 2024.

Notice of Allowance of the corresponding Japan patent application No. 2023-523614 mailed on Sep. 25, 2024.

* cited by examiner

ADAPTIVE STRAPS FOR BRASSIERE PRODUCTS AND THE METHOD OF MAKING THE SAME

CROSS-REFERENCE TO RELATED APPLICATIONS

This application is a 371 application of the International Patent Application No. PCT/CN2022/119189 filed on Sep. 16, 2022, which claims priority from U.S. Provisional Patent Application Ser. No. 63/245,206 filed 17 Sep. 2021, and the disclosures of which are incorporated herein by reference in their entirety.

FIELD OF THE INVENTION

The present invention relates to an adaptive strap for brassiere products which possesses low tensile strength during static extension to ensure wearing comfort but generates relatively high strength during oscillation stretching to provide sufficient support of the breast.

BACKGROUND OF THE INVENTION

To improve their quality of life, people living in modern cities pay more attention to their physical fitness, and exercise becomes an important daily activity. One of the physiological characteristics of women is that their breasts are glandular organs that hang from the pectoralis major without the support of bones and muscles. Exercise or daily movement will inevitably cause breast vibration, and repeating vibration of the breast over time can easily cause the sagging of the breast, thereby affecting movement during exercise and causing pain after exercise. As a result, sports underwear that can maintain the position of the breast and prevent oscillation thereof during exercise/daily movement has emerged.

Some women choose to wear an ordinary bra during exercise, due to its comfort during daily activities. However, such bras provide insufficient support during exercise. Comparing with an ordinary bra, a sports bra can provide enhanced support to decrease the displacement of the breasts. Most sports bra use elastic fabric with higher tensile strength. Although such bras can provide sufficient support for the breasts, they may cause problems such as shoulder straps digging into the skin and chafing. While some proprietary products have been developed to reduce these issues, these products are expensive with limited anti-vibration performance. As a result, there is a need for an adaptive strap for brassieres that overcomes the afore-mentioned shortcomings. The present invention addresses this need.

DISCUSSION OF THE RELATED ART

US2020/0345082A1 describes movement-reactive athletic apparel made by dipping fabric into a shear thickening fluid (STF). The STF treatment includes immersing untreated fabric in a diluted STF bath, metering an amount of the fluid on the fabric, and removing the diluent from the treated fabric. However, the ratio of diluent involved to the STF is as high as ranges of 1:1 to 10:1. In addition, the diluent may comprise methanol, ethanol, isopropanol, methylethylketone, which are flammable and easily vaporized. The dosage and species of diluent make the processing dangerous to conduct.

CN111134409A discloses a self-adaptive apparel including dynamic dilatancy which is based on strong dynamic covalent bonds or on strong dynamic supramolecular action or on both strong dynamic covalent bonds and strong dynamic supramolecular action. However, the key performance parameters of the apparel are not disclosed, such as the specific parameters of low speed and high speed, rate of tensile stress at low and high speed tensile. In one preferred embodiment, the elongation of strap is high: up to 102% at high speed tensile stress, which would still cause great pain resulting from breast displacement. Furthermore, the motion of breast during exercise is an oscillation movement instead of simple linear displacement at a sole constant speed. Therefore, the modulus evaluation at constant speed might not coincide with real usage scenario.

SUMMARY OF THE INVENTION

Therefore, there is a need for a material applied to adaptive brassiere straps that provides brassieres with low tensile strength at static extension to ensure wearing comfort whilst providing relative high strength during oscillation to provide sufficient support for the breast during exercise and/or daily movement. In the present invention, the adaptive straps include an elastic fabric and a polymer composite fabricated from a silanol terminated polydimethylsiloxane, polymer matrix, filler, boric acid and curing agent. The bra straps of the present invention demonstrate adaptive performance that provide sufficient support in different activities.

In one aspect, the present invention provides an adaptive strap for brassieres that includes at least one adaptive material layer having a first strength modulus x during static loading and a second strength modulus of at least 2× during dynamic loading of at least approximately 3Hz oscillation. Each of the adaptive material layers is sandwiched between two elastic fabric layers such that the adaptive strap is extendable up to 100% of its initial length during low wearer activity but is extendable not more than 50% during vigorous wearer activity.

In a further aspect, the adaptive strap has a thickness of less than 2 mm.

In a further aspect, the adaptive strap has a load strength of at least 7N at a static stretching of 10%.

In a further aspect, the adaptive strap has a load strength of at least 15N at a static stretching of 10% followed by a vibration stretching with 3.0 Hz.

In a further aspect, the invention includes a method of preparing the adaptive strap for brassieres. One or more silanol-terminated polydimethylsiloxanes is mixed with a polymer matrix material, and boric acid together at a reaction temperature for a period of reaction time to obtain a composite. The composite is blended with a curing agent at room temperature to form an uncured adaptive material. The uncured adaptive material is filled into a temporary shell and inserted into one or more hollow fabric structures where it is worked into the hollow fabric structure until it substantially fills a hollow space in the hollow fabric structure. The temporary shell is removed from the hollow fabric structure and cured to form the adaptive strap.

The silanol-terminated polydimethylsiloxane, polymer matrix, boric acid, and curing agent may be in a weight ratio from 5:100:0.02:0.5 to 100:100:1:3.

The silanol-terminated polydimethylsiloxane may be one or more of silanol terminated polydimethylsiloxane, silanol terminated diphenylsiloxane-dimethysiloxane copolymer, vinylmethylsiloxane-dimethysiloxane copolymer, wherein the phenyl is in a molar ratio from 0 to 18% and the vinyl is in a molar ratio from 0 to 15%.

An average molecular weight of the silanol-terminated polydimethylsiloxane may be from 650 to 139,000 g/mol.

The boric acid may be provided in an ethanol solution in a weight ratio from 1% to 10% wt. %.

The curing agent may be one or more of peroxide, a cross-linker, or a catalyst.

The composite may further include one or more fillers.

The filler may be silica dioxide, titanium dioxide, glyceryl oleate or any combination thereof.

The polymer matrix may be one or more of silicone rubber, natural rubber, synthetic rubber or a combination thereof and has a hardness from approximately 40 shore A to 80 shore A.

The curing agent may be a peroxide where the peroxide is one or more of 2,4-dichlorobenzoyl peroxide, 2,5-dimethyl-2,5-di(tert-butylperoxy)hexane, or dibenzoyl peroxide.

The curing agent may be a cross-linker and the cross-linker is selected from one or more silicon hydride compounds having at least two SiH groups.

The curing agent may be a catalyst and the catalyst is one or more of palladium, rhodium, or platinum.

The reaction temperature for obtaining the composite may be approximately 80° C. to 200° C.

The reaction time for obtaining the composite may be approximately 0.5 to 8 hours.

The curing temperature may be from approximately room temperature or 25° C. to 200° C.

The curing time may be from approximately 0.5 to 24 hours.

The adaptive strap for a brassiere may have a tensile strength of more than 4 Mpa at 2.0 Hz after 960 circles and a tensile strength no less than 1 MPa at static status under the strain of 10%.

DETAILED DESCRIPTION

Figure 1A:
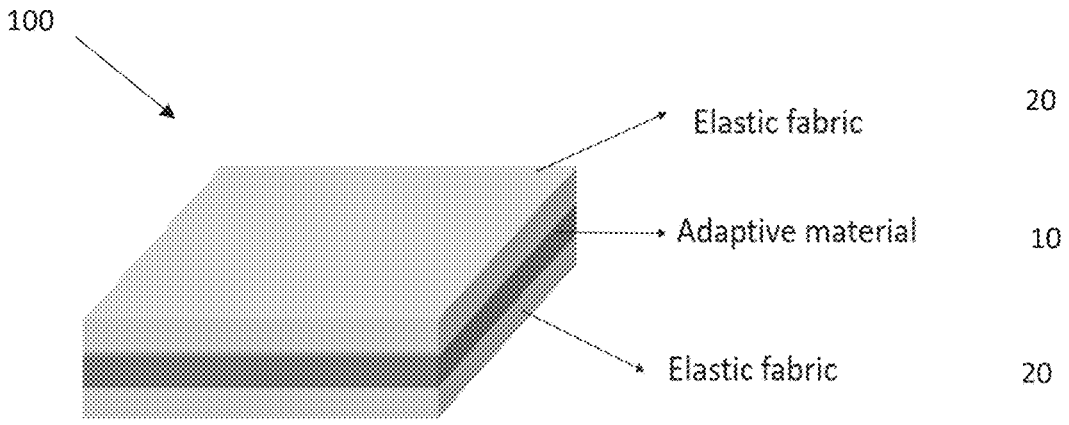
FIG. 1A shows the schematic structure of a material for adaptive straps for brassiere products.

The present invention provides an adaptive strap for brassieres. In one aspect, the material 100 for the adaptive strap, shown in FIG. 1, includes at least one adaptive material layer 10, and two elastic fabric layers 20. Each of the adaptive material layers 10 is sandwiched between two of the elastic fabric layers 20. The thickness of material 100 in an embodiment is selected to be 2 millimeters or less. As used herein, the term "adaptive material" means a material that possesses low tensile strength under static loading conditions while possessing high tensile strength during high velocity oscillation. In this manner, the material "adapts" to the loading condition, providing the wearer comfort during ordinary movement where the material is generally soft and stretchable, while providing high support levels to the breasts during vigorous exercise due to the higher modulus in response to the increased dynamic loading. In general, the adaptive material has a first strength modulus "x" during static loading and a second strength modulus of at least "2×" during dynamic loading of at least approximately 3 Hz oscillation. Exemplary mechanical properties of material 100 are a load strength of no less than 7N at a static stretching of 10% in one aspect. In another aspect, material 100 exhibits a load strength of at least 15N at a static stretching of 10% followed by a vibration stretching with 3.0 Hz.

Figure 1B:
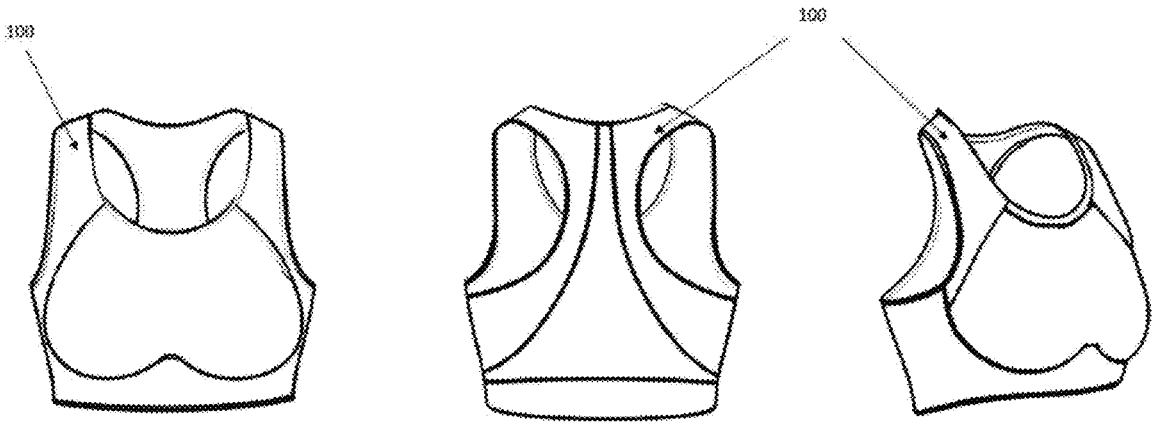
FIG. 1B shows potential locations for the material/adaptive straps of FIG. 1A in a sports bra.
Figure 2:
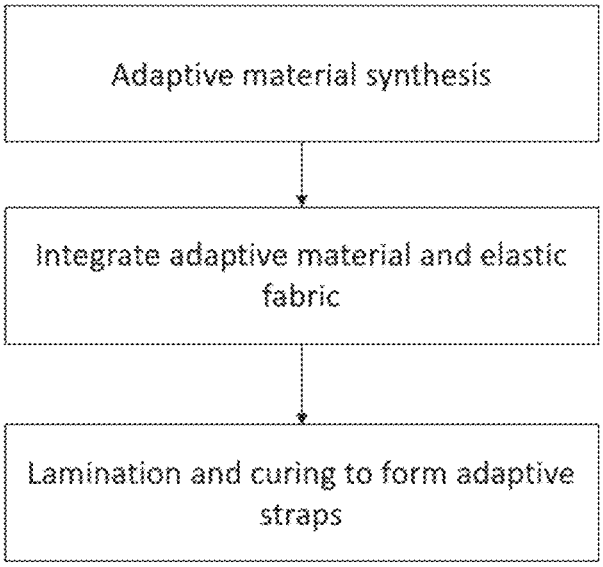
FIG. 2 shows the process flow chart of the adaptive straps for brassiere in the present invention.
Figure 8:
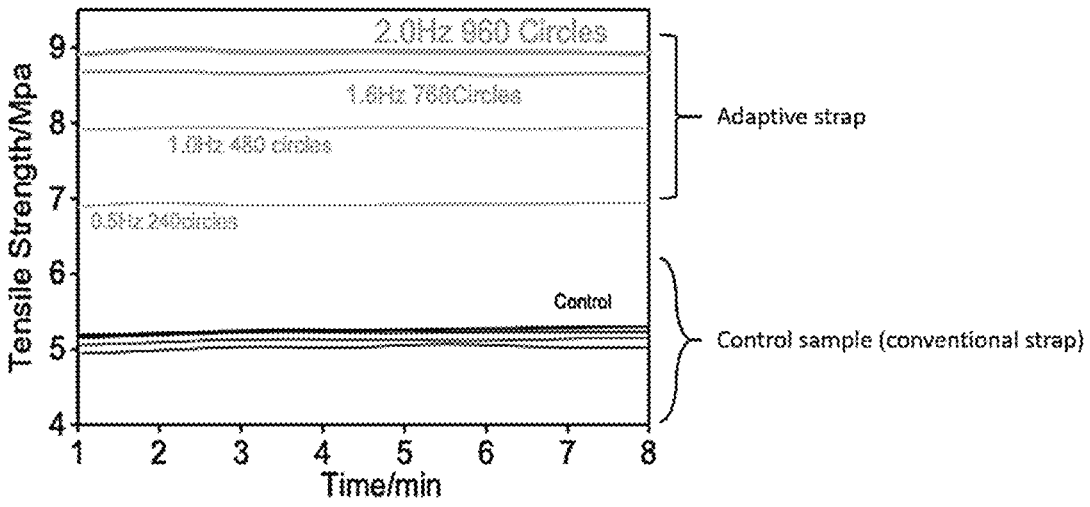
FIG. 8. Tensile strength result of adaptive strap for brassieres tested by DMA in example 3.

Because breasts move in an approximately figure-8 or "butterfly" pattern during exercise, the adaptive straps of the present invention may be used not only in the shoulder straps but in side bands, across the back, and lower support bands beneath the breast as depicted in FIG. 1B. Other configurations for the use of the adaptive straps of the present invention are also possible, depending upon the size of the breasts being supported by the bra (using more adaptive straps/bands) and how vigorous the activity the bra is designed for use (e.g., running-more straps/band- vs. yoga or other activities with less breast motion-fewer straps/bands).

The adaptive material 10 includes a reaction product formed by reacting a silanol terminated polydimethylsiloxane, polymer matrix, boric acid and optional fillers to obtain a composite which is cured, as will be discussed in further detail below. The elastic fabric layers may be selected from one or more of elastane (a polyether-polyurea copolymer including the brand names LYCRA and SPANDEX), nylon, polyester, polyurethane, and fabrics made of mixtures and blends of these polymers). Elastomeric materials may also be used (as well as mixtures/blends of elastomers with the above elastic materials) including silicones, natural rubbers/latex, and polyurethane-based elastomers. Typically, the elastic portion 20 of material 100 is selected such that it is longitudinally extensible up to 100% of its initial length in a static loading condition.

Figure 3:
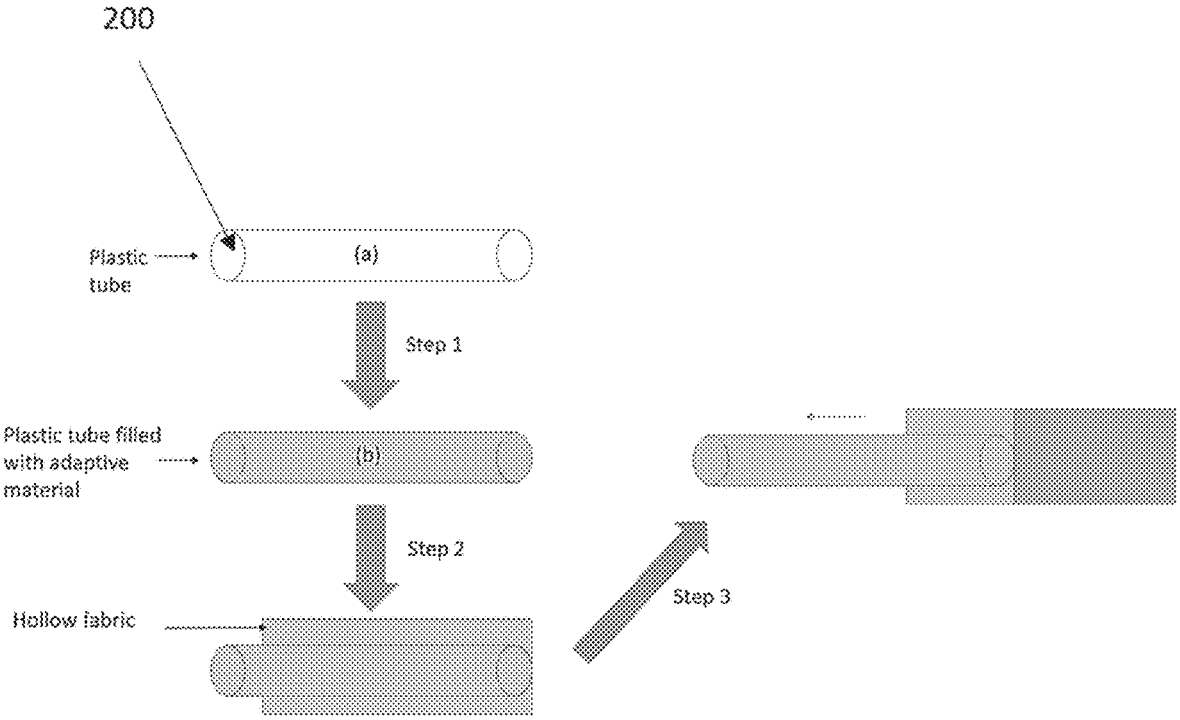
FIG. 3 shows the fabrication process of producing the adaptive strap according to an embodiment of the present invention.

In an embodiment, the fabric 100 for creating the adaptive strap of the present invention may be formed it situ with the adaptive layer 10 being cured with a shell formed by the elastic layers 20. Advantageously, this enhances the bond between the elastic layers 20 and the adaptive layer 10 such that the composite material 100 is less prone to layer delamination. Further, this in-situ technique simplifies the manufacture of the garment as the adaptive layer may otherwise be difficult to assemble into a final garment if separately formed. As seen in FIG. 3 an exemplary method of preparing the adaptive strap for brassieres includes: 1) mixing a silanol terminated polydimethylsiloxane, polymer matrix, boric acid and optional fillers together at a reaction temperature for a period of reaction time (discussed further in the Examples below) to obtain a composite; 2) blending the composite with a curing agent at room temperature to form an uncured adaptive material; 3) filling the uncured adaptive material into a tubular or other shaped removable shell 200 (e.g., a plastic tube as shown in FIG. 3); 4) inserting the uncured adaptive material filled tubular shell into one or more hollow fabric structures formed into a supportive strap or band shape that will be used in the sports bra; 5). slightly pressing in and pulling out the tubular shell from the hollow fabric structure until the uncured adaptive material substantially fills up a hollow space within the hollow fabric structure; 6). removing the temporary tubular shell from the hollow fabric structure; and 7). curing the uncured adaptive material in situ within the hollow fabric structure in order to form the adaptive strap.

In an embodiment, the silanol-terminated polydimethylsiloxane, polymer matrix, boric acid, curing agent and optional fillers are in a weight ratio with a range from 5:100:0.02:0.5:0 to 100:100:1:3:10.

The silanol-terminated polydimethylsiloxane may be one or more of silanol terminated polydimethylsiloxane, silanol terminated diphenylsiloxane-dimethysiloxane copolymer, or vinylmethylsiloxane-dimethysiloxane copolymer, wherein the phenyl is in a molar ratio from 0 to 18% and the vinyl is in a molar ratio from 0 to 15%. An average molecular weight of the silanol-terminated polydimethylsiloxane is from 650 to 139,000 g/mol. Typically, the boric acid is provided in an ethanol solution in a weight ratio from 1% to 10% wt. %. The curing agent may include peroxide, a cross-linker, a catalyst, and combinations thereof. The peroxide is one or more of 2,4-dichlorobenzoyl peroxide, 2,5-dimethyl-2,5-di(tert-butylperoxy)hexane, and dibenzoyl peroxide. The cross-linker may be selected from silicon hydride compounds having at least two SiH groups. The catalyst may be one or more of palladium, rhodium, and platinum.

The reaction temperature for obtaining the composite is from approximately 80° C. to 200° C. for approximately 0.5 to 8 hours The curing temperature is from approximately room temperature or 25° C. to approximately 200° C. and the curing time is from approximately 0.5 to 24 hours.

EXAMPLES

The following examples are presented to illustrate the present disclosure. They are not intended to be limiting in any manner.

TABLE 1

Material Formulations of the examples (all ingredients are in grams)

| | polydimethyl-siloxane | polymer matrix | boric acid | curing agent/catalyst | fillers |
|---|---|---|---|---|---|
| Example 1 | 9.974 | 100 | 0.026 | 2 | 0 |
| Example 2 | 20.96 | 100 | 1.0 | 1 | 8.04 |

Example 1

In this example, an adaptive strap was manufactured following the method of this invention as follows:

1) For homogeneous mixing, boric acid was dissolved in ethanol to form 10 wt. % solution.
2) Then 9.974 g of silanol terminated polydimethylsiloxane, 0.26 g boric acid solution, 100 g vinyl silicone rubber as the polymer matrix (shore A is 60) were mixed and stirred at 120° C. for 6 h to form a composite, wherein the molecular weight of silanol terminated polydimethylsiloxane is 49000 g/mol.
3) The above composite (110 g) and 2 g of platinum catalyst were mixed by an internal mixer at 50 r/min for 5 min.
4) Then the mixture was injected into a tubular strap with elastic fabric portions 20 made from spandex and polyester fiber. The strap along with the mixture were stored at room temperature for 24 hours for curing to form an adaptive strap with thickness of 1.46 mm.

Figure 4:
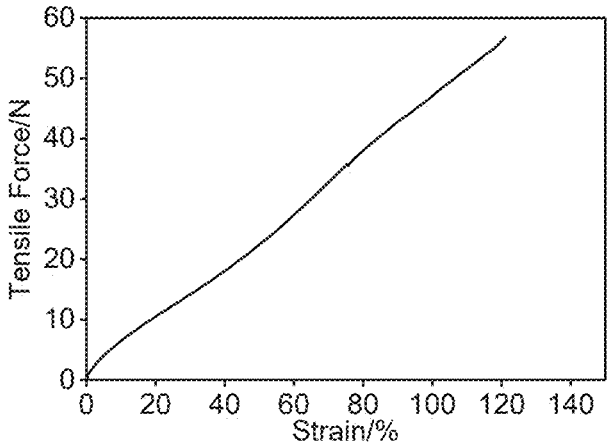
FIG. 4. Tensile-strain curves of the strap in example 1.
Figure 5:
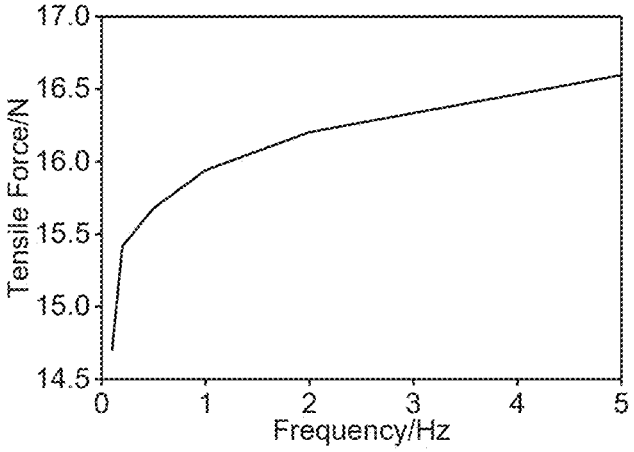
FIG. 5. Dynamic mechanical property of strap measured by DMA in example 1.

The tensile-strain curves of the strap are shown in FIG. 4. As seen in FIG. 4, the tensile force of the adaptive strap at a static strain of 10% is 6.49 N. The dynamic mechanical property of strap is measured by DMA as shown in FIG. 5. The calculated tensile force at 10% static elongation with an amplitude 8% of 3.0 Hz oscillation is 16.32 N.

Example 2

In this example, an adaptive strap was manufactured following the method of this invention as follows:

1) 10 g of silanol terminated polydimethylsiloxane (MW-650 g/mol), then 10 g of silanol terminated polydimethylsiloxane (MW-13900 g/mol), 20 g of silanol terminated diphenylsiloxane-dimethysiloxane copolymer (18% diphenylsiloxane), 20 g of vinylmethylsiloxane-dimethysiloxane copolymer (15% vinylmethylsiloxane), 2.88 g boric acid, 17 g silica dioxide (filler), 3 g titanium dioxide (filler) were mixed and stirred at 200° C. for 2 h, then 3 g glyceryl oleate (filler) to form a composite.
2) Then 100 g of vinyl silicone rubber (polymer matrix) (shore A is 60), 30 g of the above composite, 1 g of 2,5-dimethyl-2,5-di(tert-butylperoxy)hexane (curing agent) were mixed by internal mixer at 50 r/min for 5 min.
3) The mixture was injected into to tubular strap with the outer elastic material composition being spandex and nylon fiber. The strap along with the mixture were stored at room temperature for 24 hours for curing to form adaptive strap with thickness of 1.46 mm.

Figure 6:
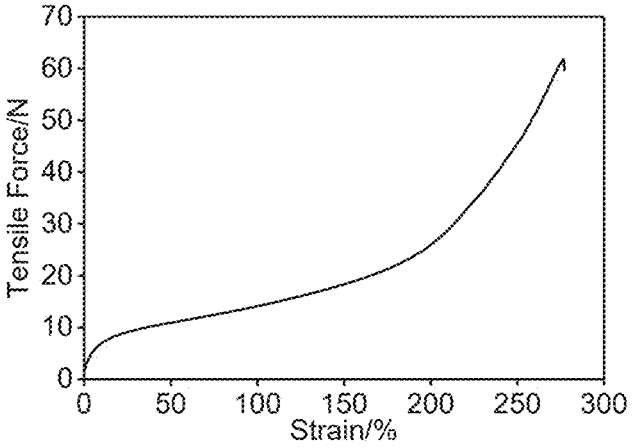
FIG. 6. Tensile-strain curves of the strap in example 2.
Figure 7:
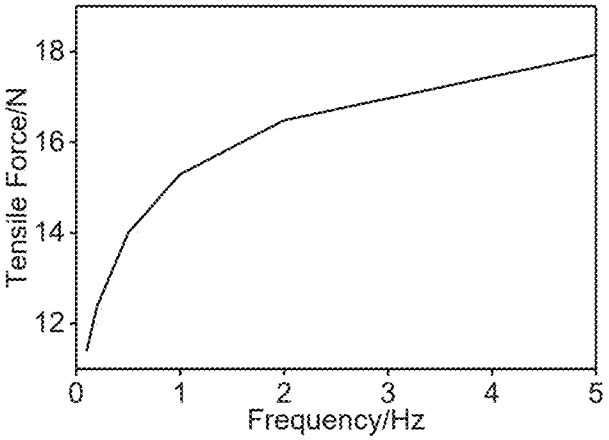
FIG. 7. Dynamic mechanical property of strap measured by DMA in example 2.

The tensile-strain curves of the strap are shown in FIG. 6. As seen in FIG. 6, the tensile force of the adaptive strap at a strain of 10% is 6.95 N. The dynamic mechanical property of strap is measured by DMA as shown in FIG. 7. The calculated tensile force at 10% static elongation with an amplitude 8% at 3.0 Hz oscillation is 16.96 N.

Example 3

In this example, an adaptive strap was manufactured following the method of this invention as follows:

1) 10 g of silanol terminated polydimethylsiloxane (MW-650 g/mol), then 10 g of silanol terminated polydimethylsiloxane (MW-13900 g/mol), 20 g of silanol terminated diphenylsiloxane-dimethysiloxane copolymer (18% diphenylsiloxane), 20 g of vinylmethylsiloxane-dimethysiloxane copolymer (15% vinylmethylsiloxane), 2.88 g boric acid, 17 g silica dioxide (filler), 3 g titanium dioxide (filler) were mixed and stirred at 200° C. for 2 h, then 3 g glyceryl oleate to form a composite.
2) Then 100 g of vinyl silicone rubber (shore A is 60) (polymer matrix), 100 g of the above composite, 1 g of 2,5-dimethyl-2,5-di(tert-butylperoxy)hexane (curing agent) were mixed by an internal mixer at 50 r/min for 5 min.
3) The mixture was injected into a tubular strap having a fabric composition of spandex and nylon fiber. The strap along with the mixture were stored at room temperature for 24 hours for curing to form the adaptive strap.

The adaptive strap for a brassiere is cut into a dimension of 4 mm*8 mm. Dynamic Mechanical Analysis (DMA) is used to precisely analyze the oscillation mechanical properties. As shown in FIG. 8, the effect of frequency for a control sample is not apparent, but the frequency can significantly affect the mechanical properties of the present adaptive straps. After 960 circles, the adaptive strap is still very stable in terms of its tensile strength.

Advantages:

Advantages of the present invention include: 1) adaptive strap for brassiere with adaptive performance to provide sufficient support during different activities; 2) a novel formulation of material for adaptive bra straps; 3) a simplified injection processes to make adaptive bra straps; and 4) quick recovery and stable performance of the adaptive bra straps.

As used herein, terms "approximately", "basically", "substantially", and "about" are used for describing and explaining a small variation. When being used in combination with an event or circumstance, the term may refer to a case in which the event or circumstance occurs precisely, and a case in which the event or circumstance occurs approximately. As used herein with respect to a given value or range, the term "about" generally means in the range of ±10%, ±5%, ±1%, or ±0.5% of the given value or range. The range may be indicated herein as from one endpoint to another endpoint or between two endpoints. Unless otherwise specified, all the ranges disclosed in the present disclosure include endpoints. The term "substantially coplanar" may refer to two surfaces within a few micrometers (μm) positioned along the same plane, for example, within 10 μm, within 5 μm, within 1 μm, or within 0.5 μm located along the same plane. When reference is made to "substantially" the same numerical value or characteristic, the term may refer to a value within ±10%, ±5%, ±1%, or ±0.5% of the average of the values.

The foregoing description of the present invention has been provided for the purposes of illustration and description. It is not intended to be exhaustive or to limit the invention to the precise forms disclosed. Many modifications and variations will be apparent to the practitioner skilled in the art.

While the present disclosure has been described and illustrated with reference to specific embodiments thereof, these descriptions and illustrations are not limiting. It should be understood by those skilled in the art that various changes may be made and equivalents may be substituted without departing from the true spirit and scope of the present disclosure as defined by the appended claims. The illustrations may not necessarily be drawn to scale. There may be distinctions between the artistic renditions in the present disclosure and the actual apparatus due to manufacturing processes and tolerances. There may be other embodiments of the present disclosure which are not specifically illustrated. The specification and the drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations.

The invention claimed is:

1. An adaptive strap for brassieres comprising:

at least one adaptive material layer having a first strength modulus x during static loading and a second strength modulus of at least 2× during dynamic loading of at least approximately 3 Hz oscillation, and two or more elastic fabric layers, wherein each of the adaptive material layers is sandwiched between two of the elastic fabric layers such that the adaptive strap is extendable up to 100% of its initial length when subjected to oscillations of less than 1 Hz and is extendable by no more than 50% of its initial length when subjected to oscillations of 3 Hz or greater.

2. The adaptive strap for brassieres of claim 1, wherein the adaptive strap has a thickness of less than 2 mm.

3. The adaptive strap for brassieres of claim 1, wherein the adaptive strap has a load strength of at least 7N at a static stretching of 10% of its initial length.

4. The adaptive strap for brassieres of claim 1, wherein the adaptive strap has a load strength of at least 15N at a static stretching of 10% of its initial length followed by a vibration stretching with a frequency of 3.0 Hz.

5. An adaptive strap for brassiere, wherein the adaptive strap has a tensile strength of more than 4 MPa at 2.0 Hz after 960 circles and a tensile strength no less than 1 MPa at static status under the strain of 10% of its initial length.

6. The adaptive strap of claim 1, wherein the at least one adaptive material layer is cured in situ within the elastic fabric layer using a curing agent.

7. The adaptive strap of claim 6, wherein the curing agent comprises one or more of peroxide, a cross-linker, or a catalyst.

8. The adaptive strap of claim 7, wherein the catalyst comprises one or more of palladium, rhodium, or platinum.

9. The adaptive strap of claim 1, wherein the at least one adaptive material layer is made from a reaction product formed by reacting a silanol terminated polydimethylsiloxane, a polymer matrix and boric acid.

10. The adaptive strap of claim 9, wherein the reaction product further comprises fillers.

11. The adaptive strap of claim 9, wherein the silanol terminated polydimethylsiloxane is selected from one or more of silanol terminated polydimethylsiloxane with phenyl and/or vinyl groups, silanol terminated diphenylsiloxane-dimethysiloxane copolymer, vinylmethylsiloxane-dimethysiloxane copolymer.

12. The adaptive strap of claim 9, wherein the silanol terminated polydimethylsiloxane has an average molecular weight of 650-139,000 g/mol.

13. The adaptive strap of claim 1, wherein the two or more elastic fabric layers comprise elastic materials, elastomeric materials, or a combination thereof.

14. The adaptive strap of claim 13, wherein the elastic materials comprise elastane, nylon, polyester, polyurethane, or a combination thereof.

15. The adaptive strap of claim 13, wherein the elastomeric materials comprise silicones, natural rubbers/latex, and polyurethane-based elastomers.

16. A brassiere product comprising the adaptive strap of claim 1.

* * * * *